United States Patent [19]

Miner

[11] Patent Number: 4,600,444

[45] Date of Patent: Jul. 15, 1986

[54] PIPE END AREA CLEANING SYSTEM

[76] Inventor: Robert M. Miner, 1855 Glendale Ave., Casper, Wyo. 82609

[21] Appl. No.: 615,341

[22] Filed: May 30, 1984

[51] Int. Cl.[4] ..... B08B 9/02

[52] U.S. Cl. ..... 134/8; 15/88; 15/104.04; 15/104.05; 134/10; 134/22.11

[58] Field of Search ..... 15/104.03, 104.04, 104.05, 15/104.1 R, 88; 134/8, 10, 22.11, 23

[56] References Cited

U.S. PATENT DOCUMENTS

| | | | |
|---|---|---|---|
| 2,838,778 | 6/1958 | Von Arx | 15/104.03 |
| 3,400,418 | 9/1968 | Downing | 15/104.04 |
| 3,435,479 | 4/1969 | Gibson | 15/104.04 |
| 3,436,783 | 4/1969 | McCartney | 15/104.04 |
| 3,495,288 | 2/1970 | Ford | 15/88 |
| 3,895,463 | 7/1975 | Brandli et al. | 15/88 |
| 3,988,798 | 11/1976 | Kratt | 15/88 |
| 4,157,096 | 6/1979 | Miller, Jr. | 15/104.03 |
| 4,166,301 | 9/1979 | Smith | 15/104.04 |
| 4,221,264 | 9/1980 | Haggard | 15/104.04 |
| 4,372,003 | 2/1983 | Toelke | 15/104.04 |

*Primary Examiner*—S. Leon Bashore
*Assistant Examiner*—K. M. Hastings
*Attorney, Agent, or Firm*—Henry W. Cummings

[57] ABSTRACT

To thoroughly clean, both the inside and outside of pipe and tubing, and both the threaded end and the coupling end of pipe and tubing, for a distance of 18 to 24 inches from end of pipe, a cleaner assembly includes at least one rotating brush that revolves around the outside of the pipe and at least one brush that rotates inside of the pipe. Preferaby one internal brush is provided for the threaded end and two brushes are provided for the coupling end. The second internal brush is larger and cleans the coupling threads as the pipe is moved into and from the cleaner. Cleaning fluid is introduced to the brushing areas, and is reclaimed during the cleaning operation. The cleaner is attached to a raising and lowering device that also accepts a removable spray cover and a pipe seal. The raising and lowering unit is mounted on a stand that contains the fluid collection, fluid cleaning and fluid storage system.

31 Claims, 16 Drawing Figures

PIPE END AREA CLEANING SYSTEM

BACKGROUND OF THE INVENTION

In U.S. Pat. No. 2,838,778 issued to Von Arx in 1958 apparatus for cleaning the inside and thee outside of pipe is disclosed. However, the assembly for cleaning the interior of the pipe is complicated and expensive.

U.S. Pat. No. 3,436,783 discloses an apparatus for cleaning the interior of pipe. This apparatus is portable.

U.S. Pat. No. 4,433,448 discloses apparatus for cleaning the exterior of pipe and apparatus for varying the diameter of the brush assembly to treat the pipe.

U.S. Pat. No. 4,166,301 discloses brushes for treating the exterior of the pipe and a scraper or blade with a plurality of cutting edges rather than brushes to clean the interior of the pipe.

U.S. Pat. No. 4,372,003 discloses a portable unit for treating both the outside of treaded and the inside, but the apparatus does not allow the simultaneous treatment of both the inside and the outside of the pipe.

SUMMARY OF THE INVENTION

The object of the invention is to thoroughly clean both the inside and outside of both the threaded end and the coupling end of pipe and tubing of foreign matter, for a distance of 18 to 24 inches from end of pipe.

In accordance with the present invention a cleaner assembly includes at least one rotating brush that revolves around the outside of the pipe and at least one brush that rotates inside of the pipe. Preferably one internal brush is provided for the threaded end and two brushes are provided for the coupling end. The second internal brush is larger and cleans the coupling threads as the pipe is moved into and from the cleaner. Cleaning fluid is introduced to the brushing areas, held captive and reclaimed during the cleaning operation.

The cleaner assembly is attached to a raising and lowering device that also accepts a removable spray cover and pipe seal.

The raising and lowering unit is mounted on a stand that contains the fluid collection, fluid cleaning and fluid storage system.

THE DRAWINGS

Figure 5:
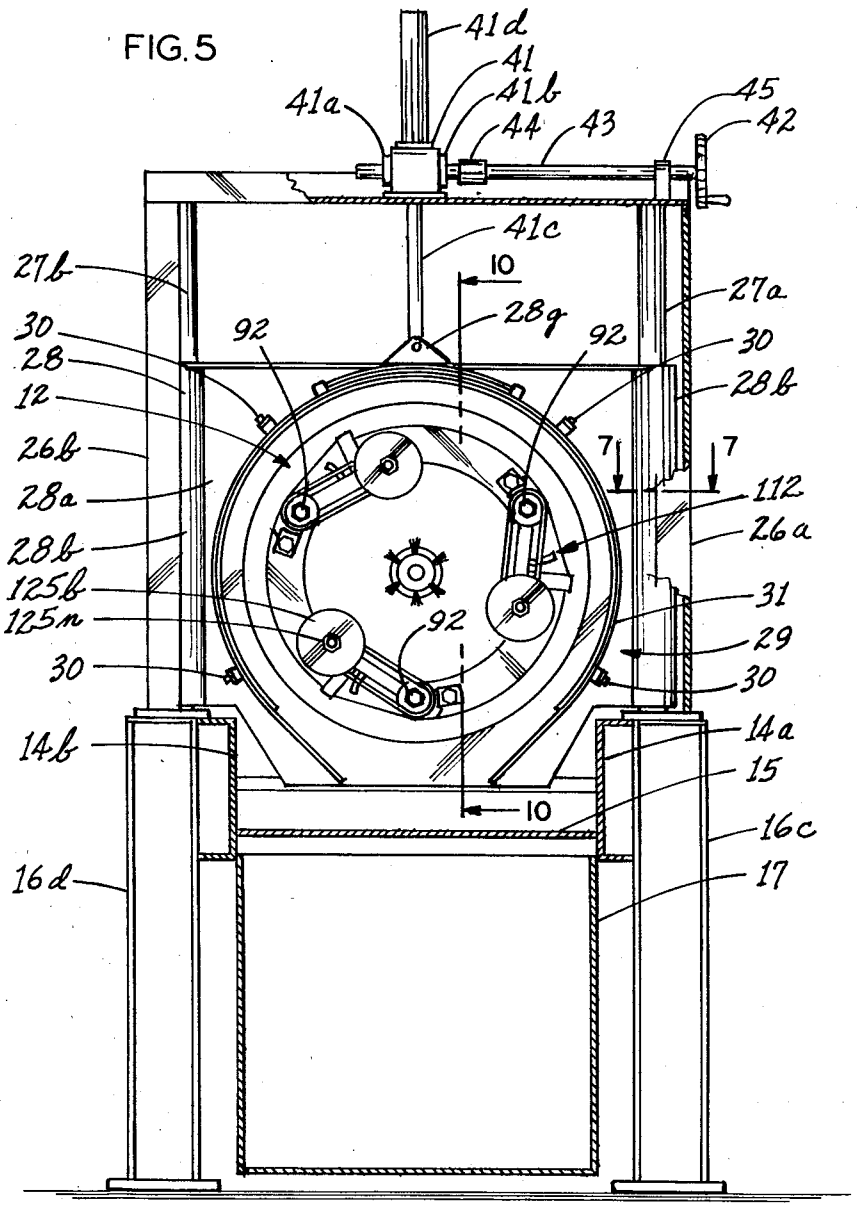
FIG. 5 is a sectional view looking in the direction of the arrows along the line 5—5 in FIG. 4.
Figure 10:
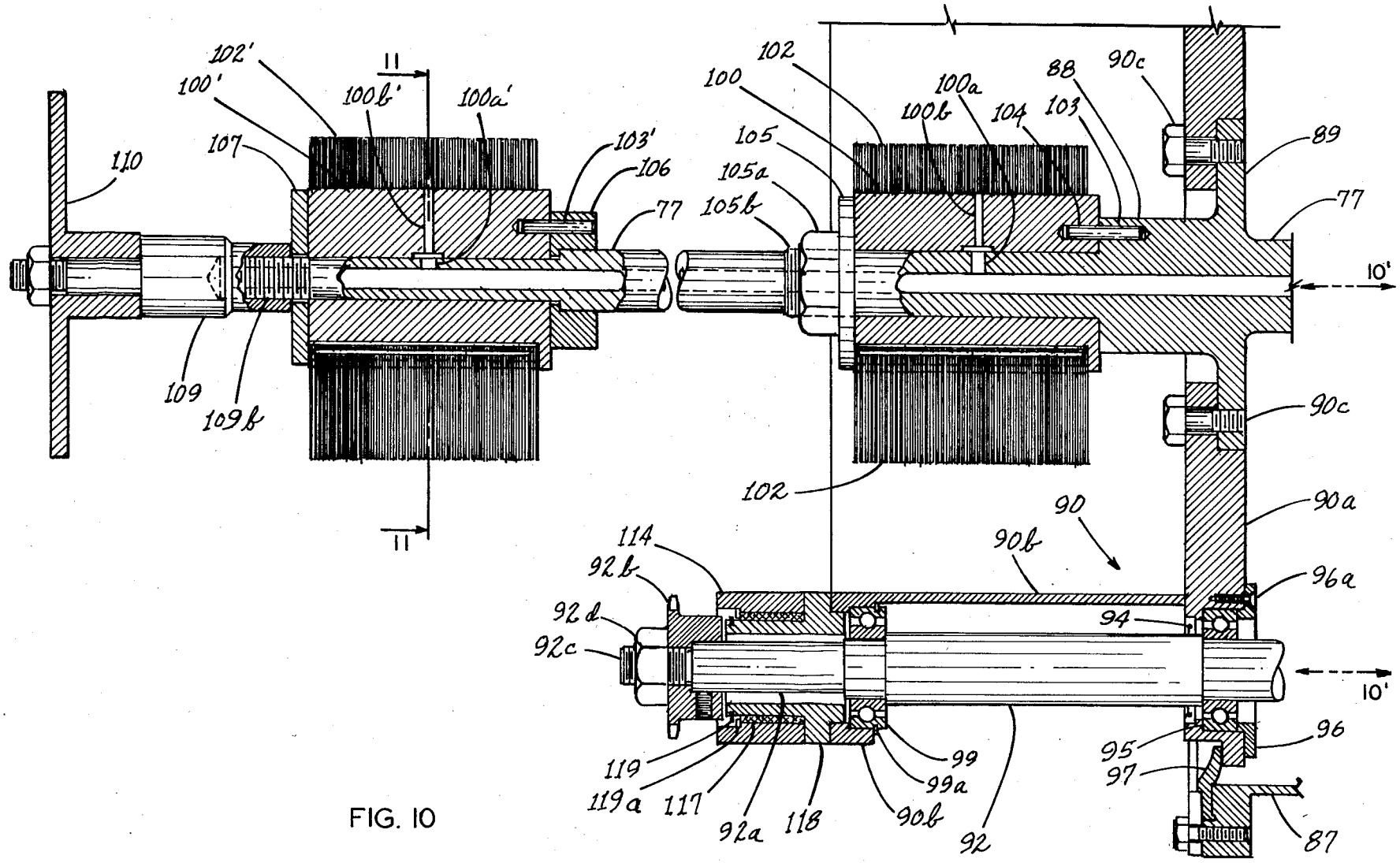
Figure 10:
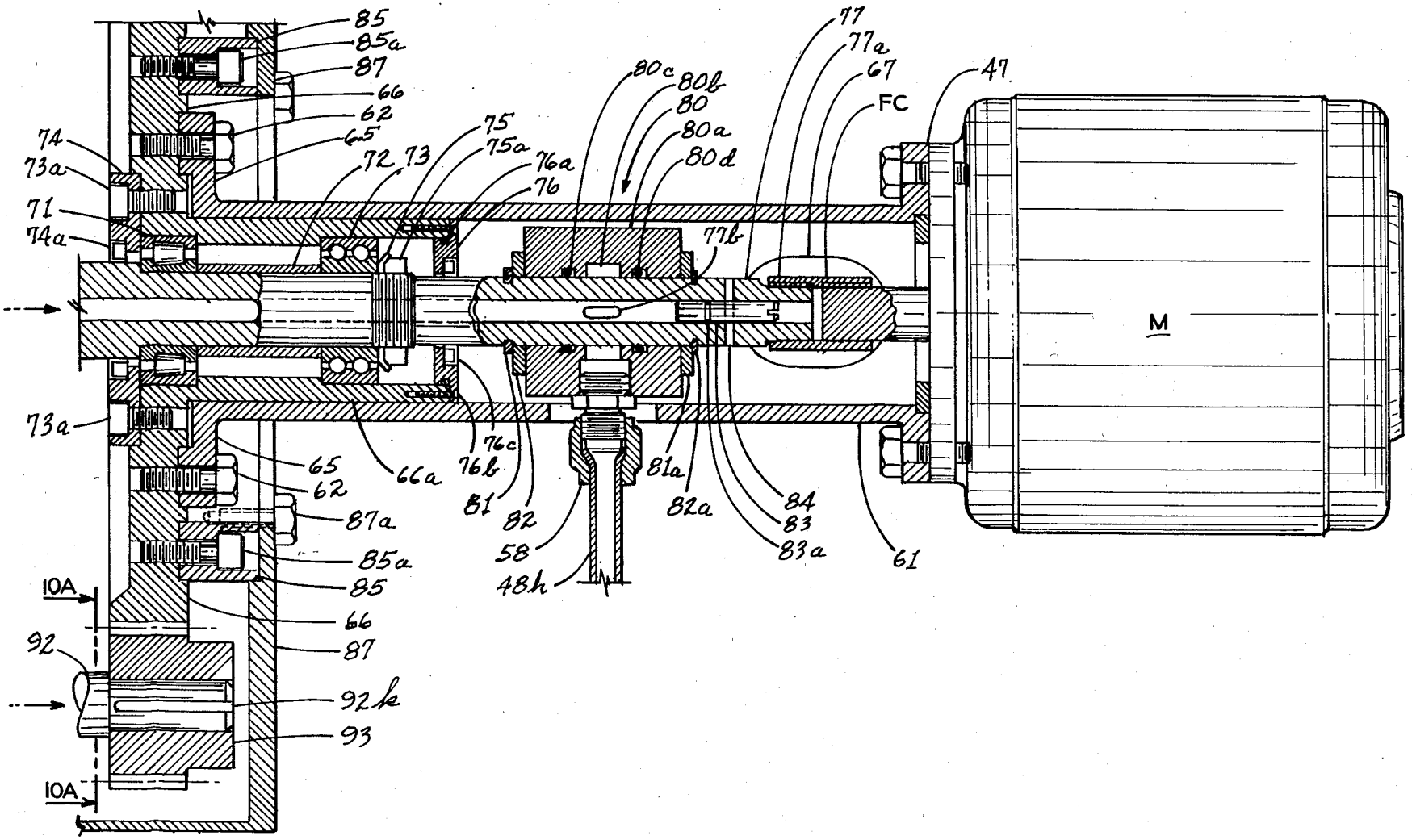

FIG. 10 and 10' is a vertical sectional view looking in the direction of the arrows along the line 10—10' in FIG. 5 with portions of the links support assembly removed for clarity.

Figure 10A:
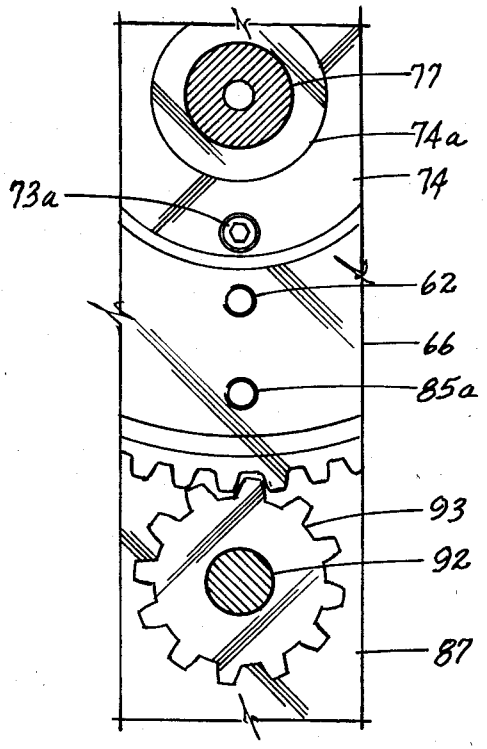

FIG. 10A is a sectional view looking in the direction of the arrows along the line 10A—10A in FIG. 10.

Figure 11:
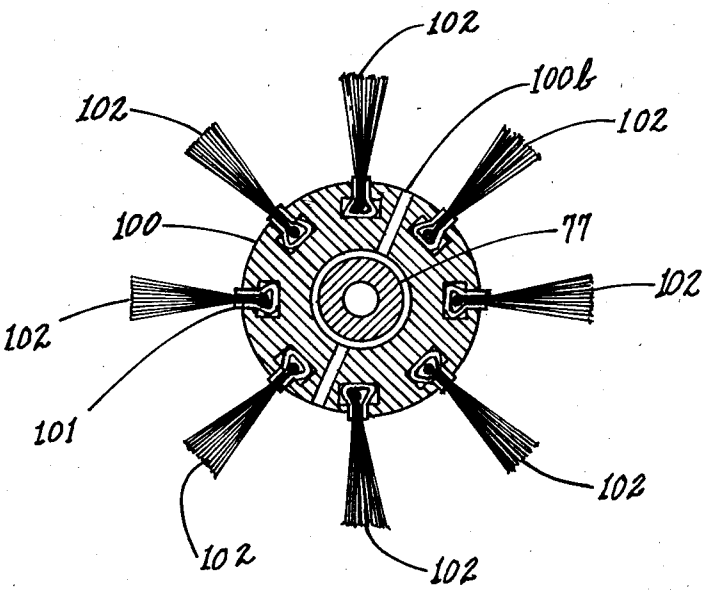

FIG. 11 is a sectional view looking in the direction of the arrows along the line 11—11 in FIG. 10.

Figure 12:
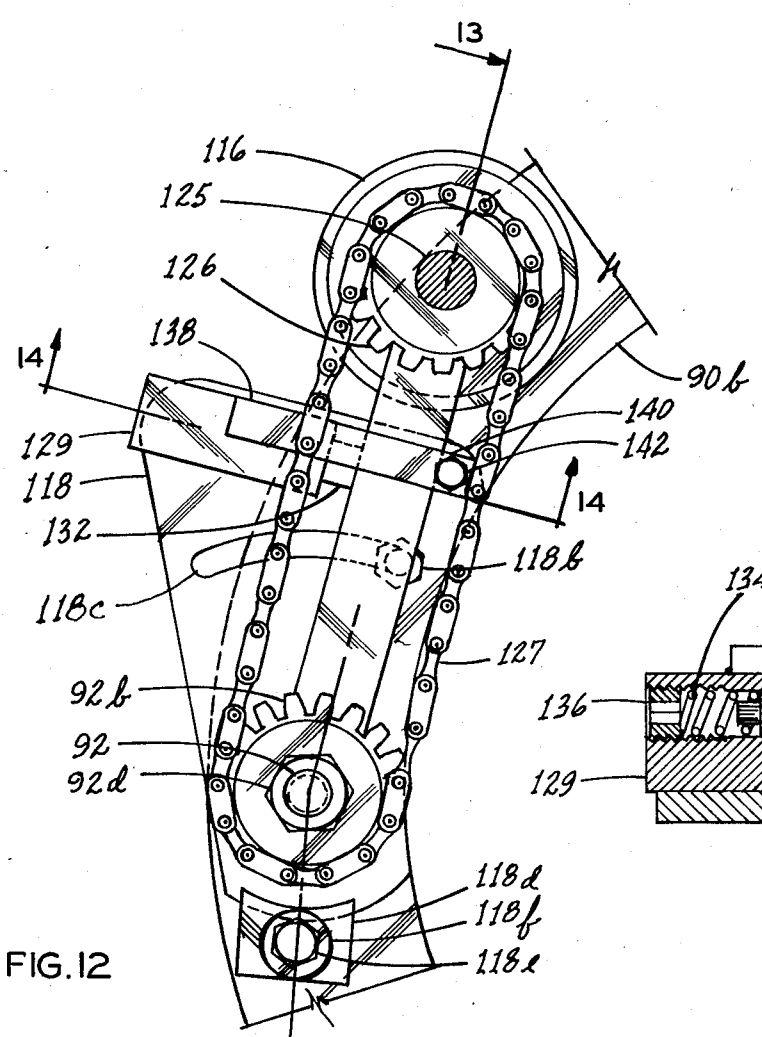

FIG. 12 is an enlarged view of a portion of FIG. 5.

Figure 13:
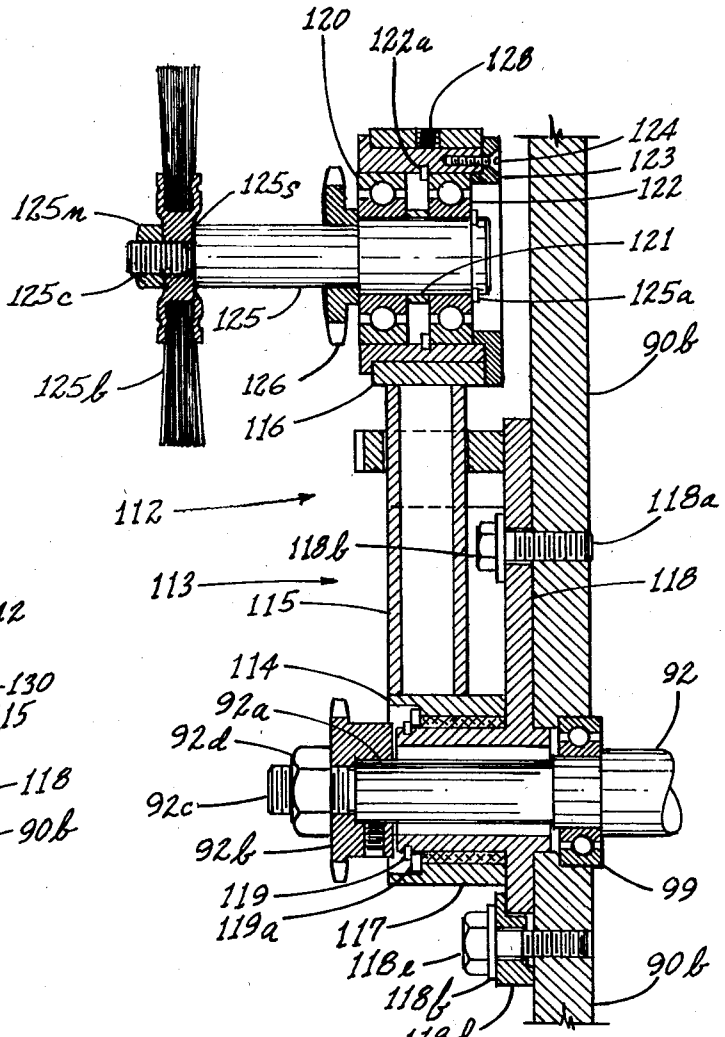

FIG. 13 is a sectional view looking in the direction of the arrow, along the line 13—13 in FIG. 12.

Figure 14:
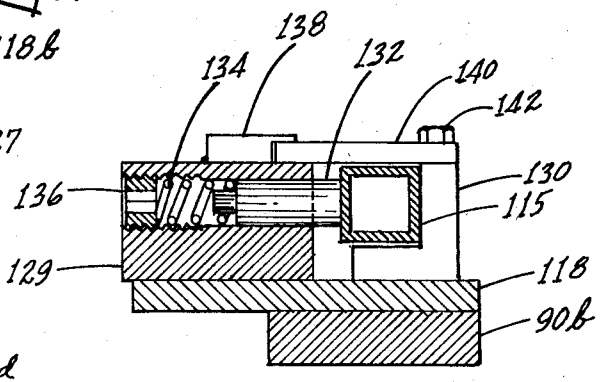

FIG. 14 is a sectional view looking in the direction of the arrows along the line 14—14 in FIG. 12.

DESCRIPTION OF PREFERRED EMBODIMENTS

Figure 1:
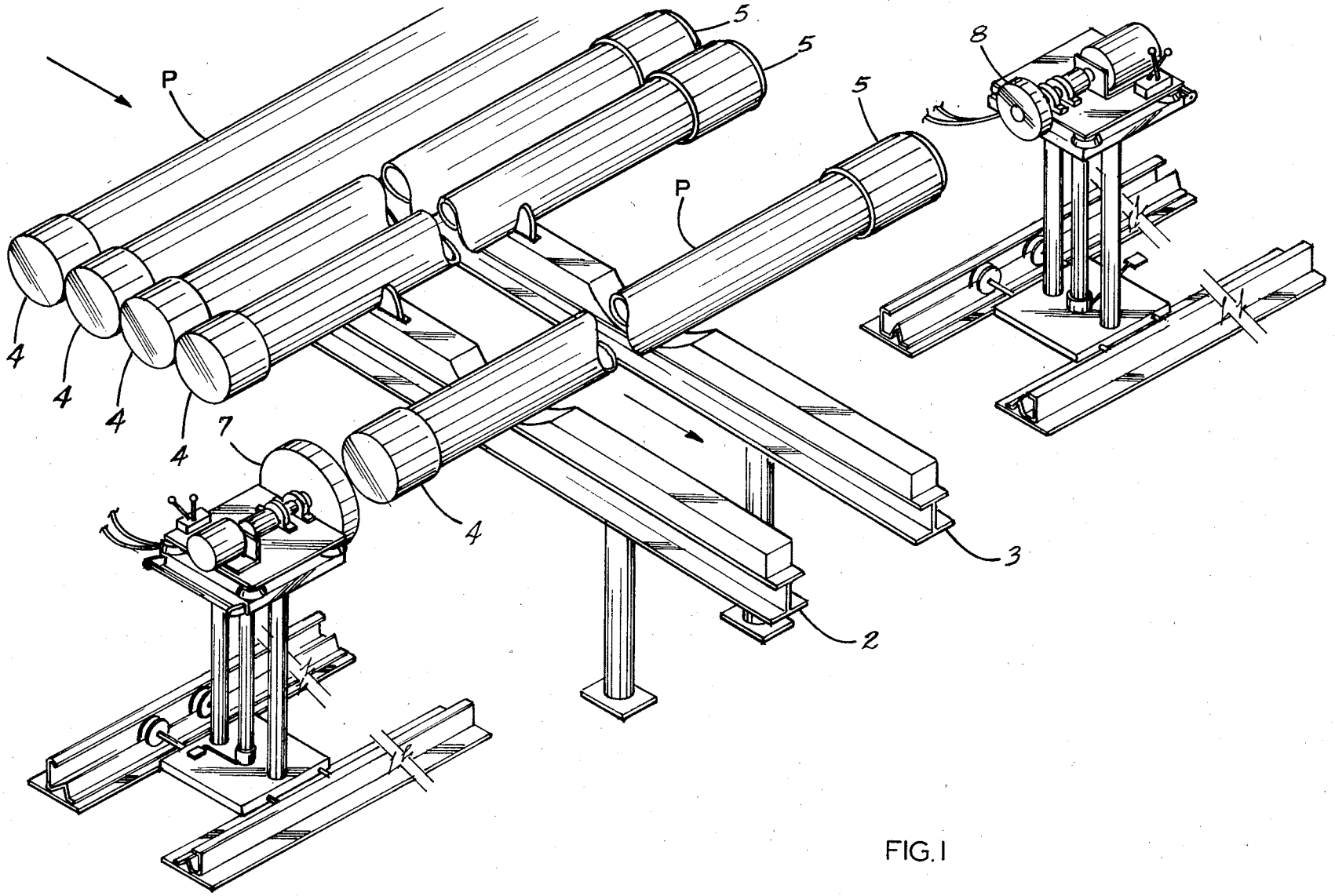
FIG. 1 is a schematic perspective view illustrating pipe to be cleaned containing thread protectors at either end and pipe racks supporting the pipe, and thread protector removal assembly at either end of the pipe.

The usual procedure of pipe inspection is to roll the pipe P (FIG. 1) on pipe racks 2, 3 from one operation to another. First the thread protectors 4, 5 are removed, for example according to U.S. Pat. No. 4,442,737 and illustrated at 7 and 8. Next drifting and magnetizing of the pipe occurs which is not a part of this invention. However, drifting is discussed in U.S. Pat. No. 4,354,379. Then the pipe is rolled to the end area cleaning station.

At the end area cleaning station the pipe drops slightly off the pipe racks 2, 3 onto a series of power driven urethane vee rollers 9 (FIG. 2) that move the pipe laterally either direction into the pipe cleaners 10 and 12 of the present invention, first one end (FIG. 10) then the other.

The height of the pipe racks 2, 3, and vee rollers 9 is constant. Thus the height of pipe center line varies with the diameter of pipe. It becomes necessary to raise or lower the center line of the cleaners accordingly.

The cleaners 10 and 12 of the present invention are located at each end and are constructed in the same manner except where indicated.

Four legs **16*a*, 16*b*, 16*c* and 16*d*, two sides 14*a* and 14*b* and a pan 15 are welded together as a base for the system. A tank 17 of ¼" plate with a partition 19 (FIG. 6) is welded between channels (14). A screen basket 18 (FIG. 6) is placed in smaller compartment 17*a* of tanks (17) under spout (15*s*) of catch pan (15**).

Figure 3:
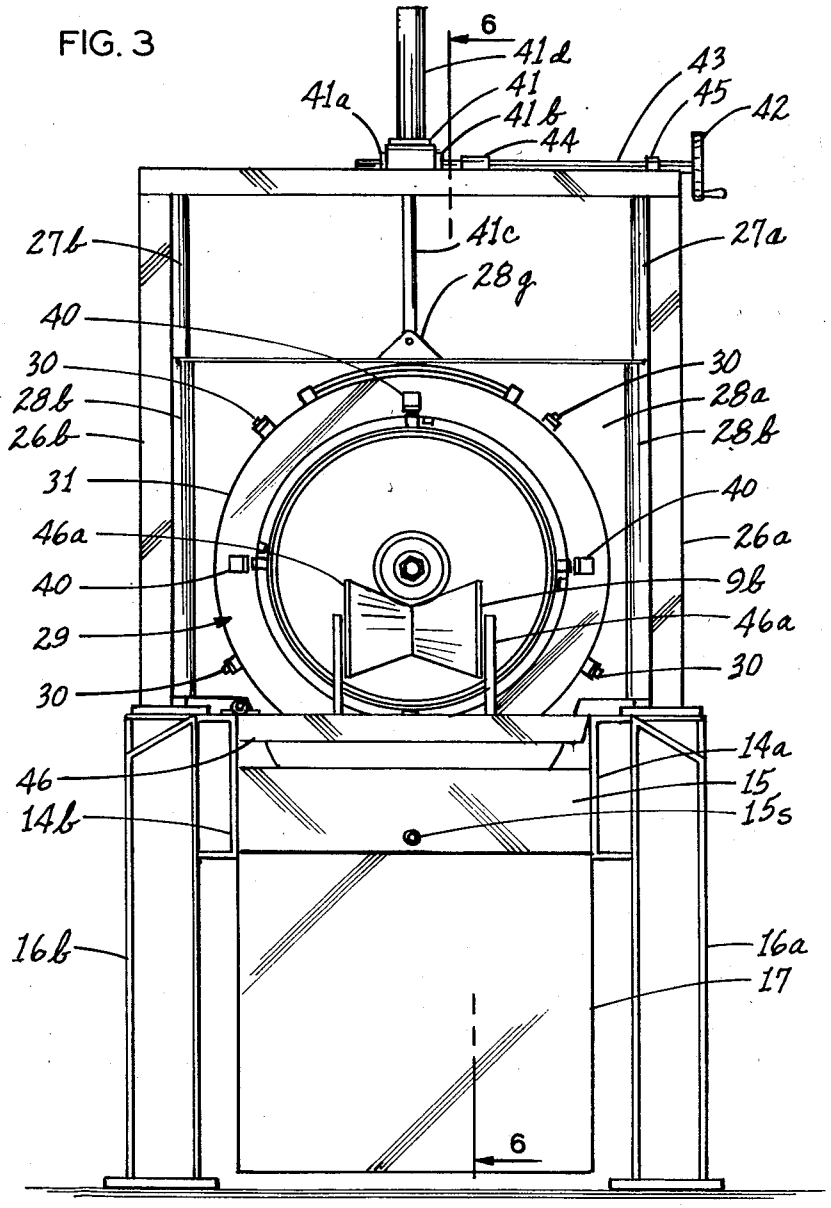
FIG. 3 is a front elevation view of one of the cleaning assemblies of the present invention.
Figure 4:
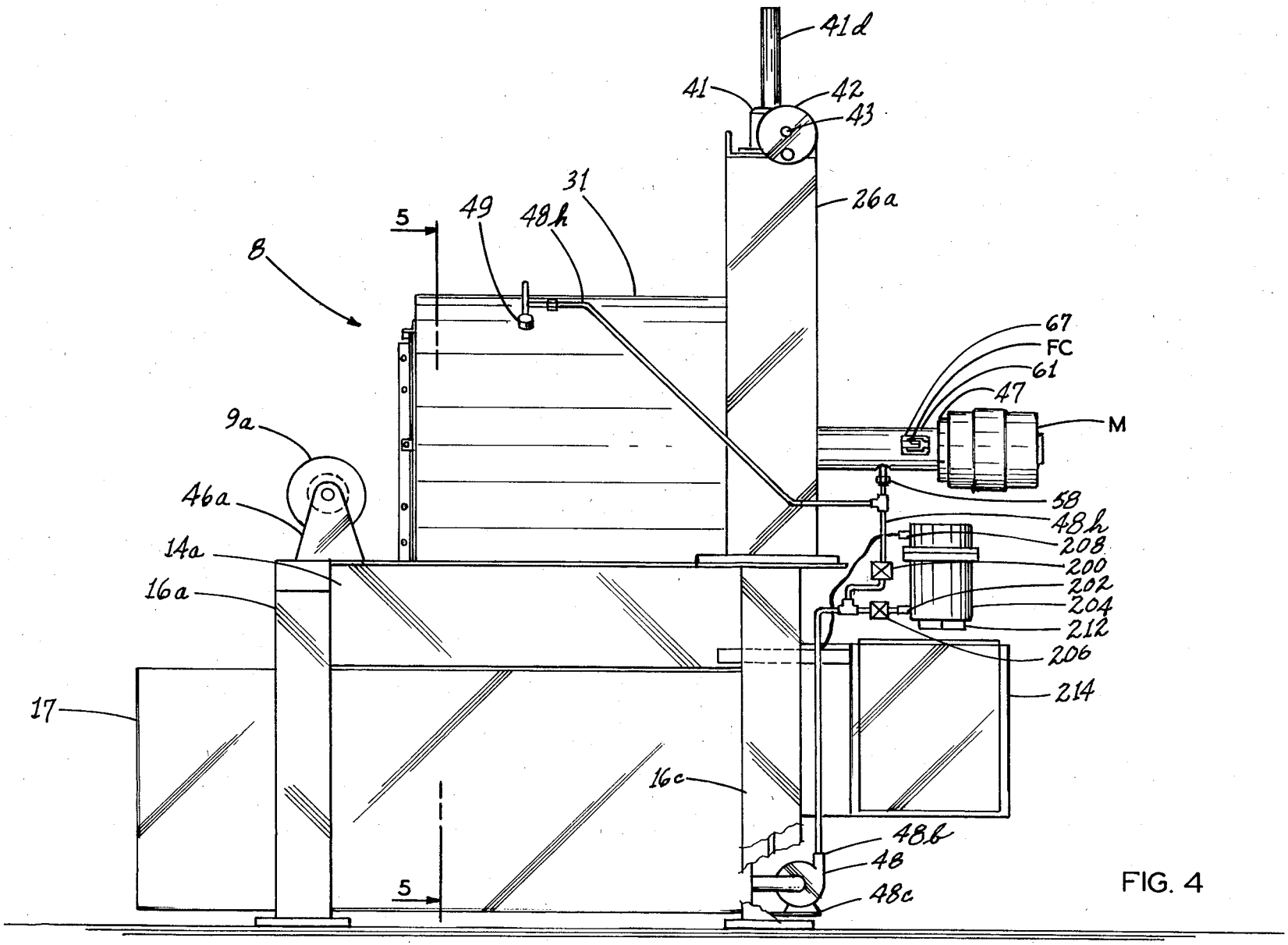
FIG. 4 is a side elevation view of the cleaning unit illustrated in FIG. 3.

As shown in FIGS. 3 and 5, a channel frame (**26*a*) and (26*b*) and two polish rods 27*a*, 27*b* are mounted on top of the two rear legs 16*c* and 16*d* of the base. A slide (28) consists of a steel plate (28*a*) welded (FIG. 5) between two steel tubes (28*b*) with a urethane bearing (28*c*, FIG. 7) cast into the tubes. The cleaner assembly 29 is fastened to the slide 28*a* with machine screws (27, FIG. 6). A partial ring (32) is welded to slide 28*a* and serves as a seat for the removable cover (31) that is held in place with suitable mechanical fasteners or catches (30) (FIGS. 3 and 5**).

Figure 8:
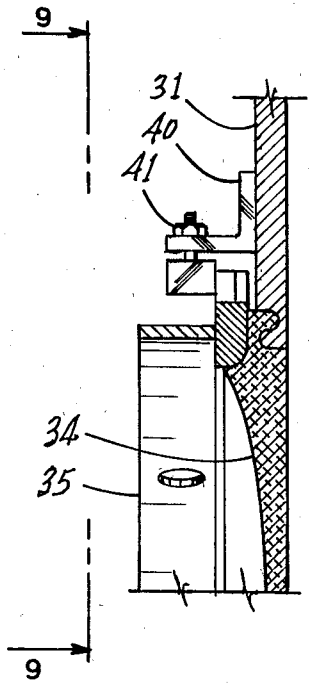
FIG. 8 is an enlarged of a portion of FIG. 6.
Figure 9:
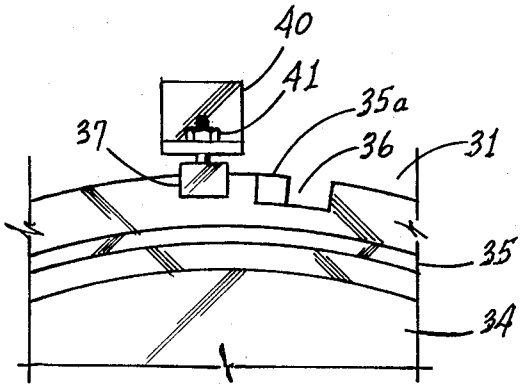
FIG. 9 is a view looking in the direction of arrows along the line 9—9 in FIG. 8.

The bottom of cover (31) is open and the end (**31*a*) opposite of the slide is machined to accept a urethane pipe seal (34), as shown in FIGS. 8 and 9. The pipe seal has a hole (34*a*) in the center that corresponds to the size of pipe being cleaned (FIG. 6) seal retaining ring (35) has a cam surface (35A) (FIGS. 8 and 9) and a series of notches (36) that correspond to cam followers (37) fastened to the cover (31) by small brackets (40) and fasteners (41). By placing the retaining ring (35) against the seal (34) with notches (36) in the ring matching cam followers (37), by turning the ring (35) several degrees clockwise, the ring engages cam followers (37) and holds seal (34) firmly in place. The ring (35**) is turned counter-clockwise to remove the seal.

The slide (28*a*) is raised or lowered as a unit by the worm gear (41) having bearing covers (41*a* and 41*b* FIGS. 3 and 5). The gear (41) is operated manually by handwheel (42) connected to gear (41) by shaft (43) and coupling (44) through bearing (45).

The worm gear (41) is attached to a shaft (41*c*) which is connected to plate (28A) by gussets (28G). The shaft (41*c*) is movable within a housing (41*d*).

The urethane vee rollers (9*a*, 9*b*) are mounted on a channel (46) with gussets (46*a*) (FIG. 6) between side channels (14*a*, 14*b*). This vee rollers (9*a*, 9*b*) are the same height as the power rollers (9) and pipe racks 2, 3 (FIG. 1) and steadies the pipe P as it enters the cleaner.

A pump (48) is mounted on a base (48*c*) with suction side (48*s*) connected to the larger compartment (17*b*) of the tank (17) and the discharge (48*d*) connected by hoses (48*h*) to spray nozzles (49) and fluid coupling connection (58) (FIG. 10).

The flexible coupling FC may be connected directly to the coupling (48). Alternatively, a valve (200) may be provided and a conduit (202) is provided to cut-off communication between the separate cleaning unit (204) and the conduit (48H). The cleaning unit (204) for example, may be a hydro cyclone. Hydrocyclone (204) is not a part of this invention and will not be described further.

Clean fluid from the hydrocyclone (204) is conveyed by means of a conduit (208) to the lines (48*h*) and thence with nozzles 49 and into the coupling (58). Impure material is removed from the hydrocyclone (204) by means of a removable bottom (212) into a container (214) which may be periodically dumped.

In most instances, fluid is conveyed only to the hydrocyclone (204) when the cleaning unit (29) is operating.

A motor M is removably attached to a flange (47). Flange (47 is part of a tube (61) (FIG. 10'). There are two openings (67) for access to flexible coupling (FC) which drivably engages mandril (77) at (77*a*).

The tube (61) has a flange (65) which is fastened to a sun gear (66) with four machine screws (62). The sun gear (66) accepts a spherical roller bearing and a double row ball bearing (73). The front bearing (71) is retained by a bearing retainer (74) and socket head cap screws (73*a*). Sleeve (72) spaces bearings (71) and (73) a proper distance apart. The bearing retainer (74) also serves as a seal housing for a rotary seal (74*a*). Lock washer (75) and lock nut (75*a*) retain mandril (77).

Bearing housing cap (76) with an o-ring (76*a*) is fastened to housing portion (66*a*) of sun gear (66) with screws (76*b*). This cap also serves as seal housing for rotary seal (76*c*).

A rotary fluid coupling (80) having a body portion (80*a*) is positioned on mandril (77) with two retaining rings (81, 81*a*), and two washers (81*a*, 82). Body portion (80*a*) includes an opening (80*b*) for solvent, and openings (80*c*) and to receive o-rings (80*d*).

Plug (83) with an o-ring (83*a*) is positioned with a dowel (84).

A spacer ring (85) is fastened to the sun gear (66) with socket head cap screws (85*a*). A gear housing (87) is fastened to the spacer ring (85) with machine screws (87*a*).

The mandril (77) is a steel tubular shaft with a hub (88) and a flange (89). A planetary bearing housing (90) includes a transverse portion (90*a*) and a longitudinal portion (90*b*). The planetary bearing housing transverse portion (90*a*) fastens to mandril flange (89) with six machine screws (90*c*).

Three planetary shafts (92) (FIG. 5) are keyed at (92*k*) for planet gears (93) (FIG. 10') on one end and are machined at (92*a*) to accept three brush shaft links (113) (FIGS. 5 and 13) on the other end and three rotary seals (94) with rear planetary bearings (95). The rear planetary bearings (95) are ball bearings and retained with a retainer (96) and screws (96*a*).

A urethane seal (97) seals between gear housing (87) and planetary bearing housing portion (90*a*) and is retained by retainer ring (96) and machine screws (96*a*). The three front planetary bearings (99) are ball bearings with a snap ring (99*a*).

The internal brush holders (100) and (100') are mounted upon mandril (77). They are molded of urethane in various diameters depending on pipe size. Grooves (101) (FIG. 11) accept replaceable strip brushes (102). The number various with the diameter of brush holder. The brush holder (100) seats against mandril hub (88). The dowels (103) are compatible with holes (104) in the brush holder (100). Brush retaining plate (105) is held against brush holder with a nut (105*a*) (FIG. 10) on threads (105*b*). The outside diameter of the brush retaining plate (105) is only slightly less than that of the brush holder so that the retaining plate holds strip brushes in their respective grooves. A different diameter plate (105) is needed for each size brush holder. The internal brush holder is elminated from the cleaner assembly (12) at the pin end of the pipe (FIG. 2).

Hub (106) is keyed to the mandril (77) but may be removed by hand. The internal pipe brush holds (110') fits against hub (106) and dowels (103') and is held in place with brush retaining plate (107).

Figure 2:
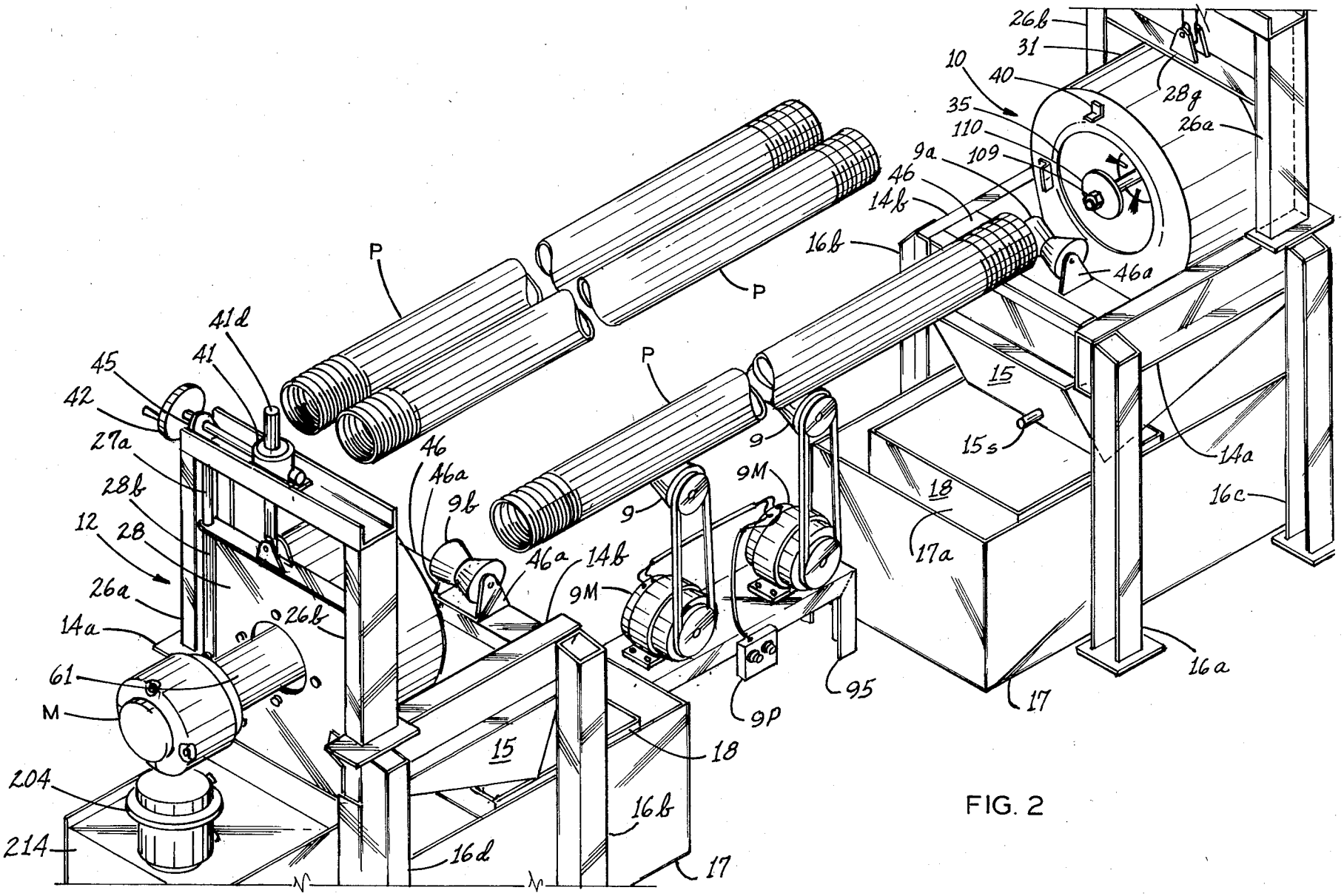
FIG. 2 is a schematic illustration of the tubing and pipe cleaning apparatus of the present invention with cleaning units located at opposite ends of the pipe to be treated.

Threads (105*b*) retainer (105), opening (100*a*) and brush (102) and dowels (103) are omitted on the mandril (47) for the cleaner (12) at the pin end of the pipe (FIG. 2).

Figure 6:
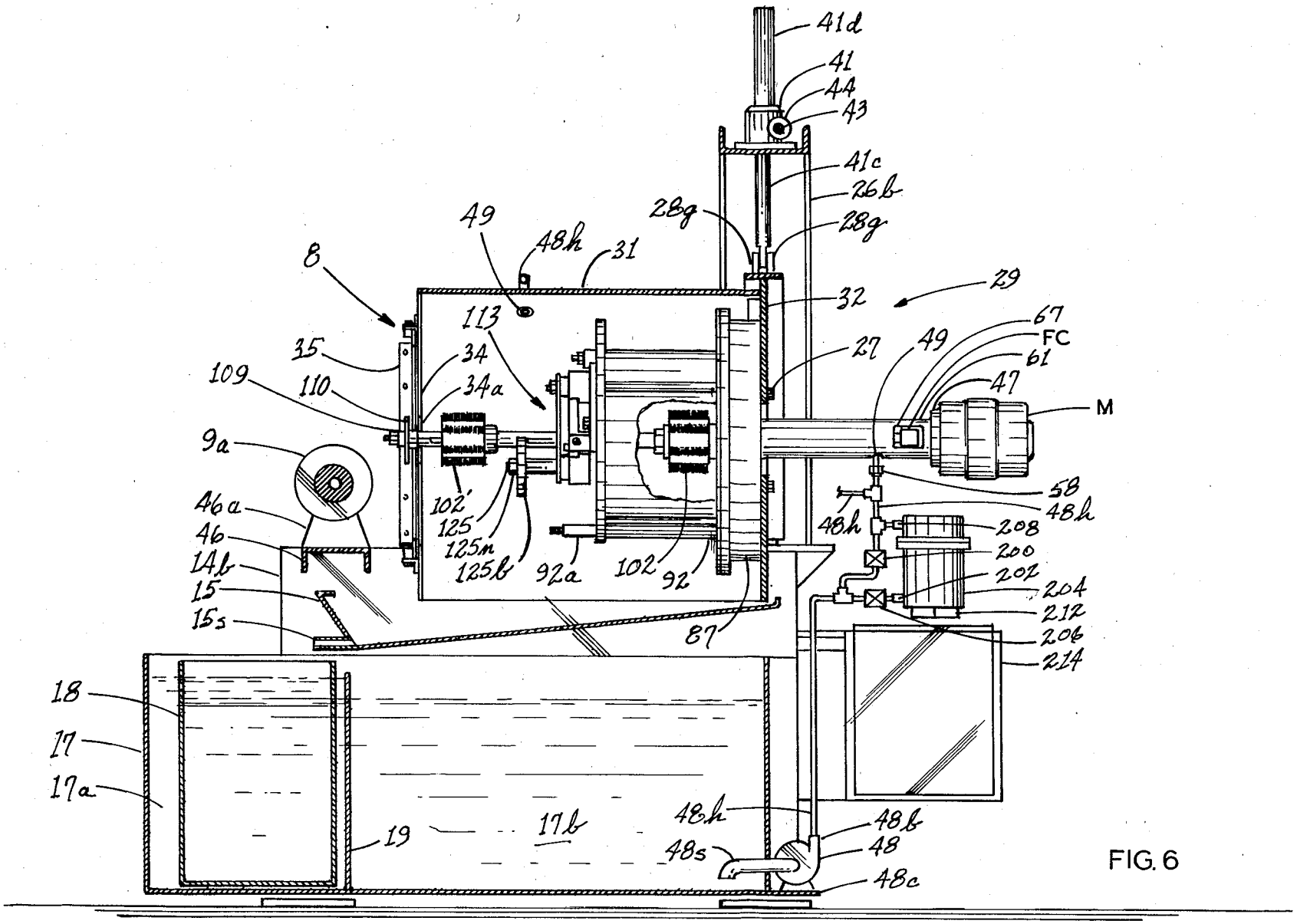
FIG. 6 is a vertical section view looking in the direction of the arrows along the line 6—6 in FIG. 5.
Figure 7:
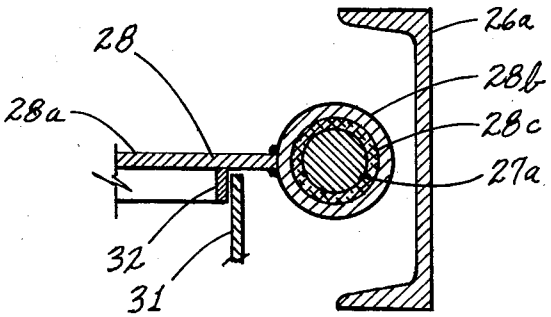
FIG. 7 is a sectional view looking in the direction of the arrows along the line 7—7 in FIG. 5.

A nut (109) for the wiper seal (110) serves a nut to screw on threads (105*b*), a cap for the bore through the mandril (77) and as a mandril for a urethane wiper seal (110) (FIG. 6).

The three brush adjusting bracket and link support (112) assemblies are installed over planetary shafts (92). They are secured to planetary bearing housing portion (90*b*) which is ring shaped (FIG. 12) with a machine screw (118*a*) (FIG. 13) having a nut (118*b*) through adjusting slot (118*c*) and a clamp (118*d*) held in place by a machine screw (118*e*) and washer (118*f*).

The brush shaft link (113) is shown as a weldment (FIG. 13) consisting of a bearing housing (114), arm (115) and eccentric housing (116). This may be a casting or forging. A bronze bushing (117) is pressed into housing (114). The bearing surface is between the bushing (117) and the support (118). The retaining ring (119) and steel washer (119*a*) secure the brush shaft link to the support (118).

The eccentric bearing housing (116) houses two ball bearings (120, 122) that are positioned by a spacer (121) a retaining ring (122*a*) and bearing retainer (123) held in place with machine screws (124).

The brush shaft (125) is held in bearings (120, 122) by a retaining ring (125*a*). A sprocket (126) is keyed to shaft (125) and is aligned with a sprocket (92*b*) that is keyed to planetary shaft (92) having a threaded stud (92*c*) held in place with a nut (92*d*). A roller chain (127) connects the two sprockets (92*b*) and (126). Chain tightness is adjusted by rotating eccentric bearing housing (116), and is held in adjustment by set screw (128). A gear belt and gear belt pulley may be used in lieu of the roller chain and sprockets illustrated.

Brush shaft link stops (129) and (130), FIG. 14 are welded to the brush adjusting bracket and link support (118). Link stop (129) is bored to accept a plunger (132), spring (134) and adjusting screw (136). Catch (138) is integral with stop (129). The removable cage bar (140) is secured by catch (138) and machine screw (142) which is threaded into stop (130).

Thus it is seen that the Basic Cleaner Stator includes sun gear (66) with bearing housing (87), motor to cleaner housng (61) and spacer ring (85) shown in FIG. 10.

The Basic Cleaner Rotor includes a tubular mandril (77), planetary bearing housing (90), three planetary shafts (92) (FIG. 5) with planetary gears (93) (FIG. 10') and three brush shaft links (113).

OPERATION

A motor M is mounted on mounting flange (47) and connected to the mandril (77) through a flexible coupling (FC) and keyed to mandril keyway (77*a*). The planetary bearing housing (90) rotates with the mandril (77), revolving the three planet gears (93) around sun gear (66). This rotates the three planetary shafts (92) at a ratio of 4:1 or 5:1 to the motor and mandril (77).

The rotary motion of the planetary shafts (92) is transmitted through the adjustable brush shaft links (113) (FIG. 13) by chains (127) to the brush shafts (125) and wheel brushes (125*b*) attached to brush shafts (125) by threads (125*t*) and nut (125*N*) (FIG. 6). These external brushes are adjusted for various size pipe by loosening screws (118*a*) and (118*d*) and rotating the adjusting bracket and link support (118) towards or away from the center of the cleaner, depending upon the diameter of pipe to be cleaned and then locking in desired position with nuts (118*b*) and (118*e*). The spring (134) and plunger (132) permit the brush shaft link to rotate slightly on bushing (117) allowing brushes (125*a*) to move out for pipe couplings.

Cleaning fluid or solvent is pumped from tank (17*b*) to a hose fitting (58), through groove (80*b*) in rotary coupling (80) through opening (77*b*) into center of mandril (77), then through opening (100*a*) and/or (100*a*') into grooves (110*b*), and/or (100*b*') of brush holder (100 and/or 100') thus into the cleaning area inside the pipe being cleaned. Fluid is prevented from moving into the pipe farther than the cleaning area by a nut (109) from urethane wiper seal (110) of proper diameter on threaded portion (109*a*) (FIG. 10). This wiper seal also wipes out fluid and foreign matter when the pipe being treated is withdrawn.

With the cleaner running and the pump (48) pumping cleaning fluid from tank (171) to nozzles (49) in cover (31) and rotary fluid coupling (58) (FIG. 10) on brush mandril (77), the pipe P is moved over the vee roller (9*a*), wiper (110), through seal (34), over internal brushes (102') and between the external brushes (125*b*) as far as the cleaner will permit. Then as pipe is withdrawn from the cleaner the wiper (110) wipes fluid and loosened debris from inside of pipe. After cleaning the pipe in cleaner unit (10), the pipe is inserted into cleaner (12) as shown in FIG. 2 and the cleaning process is repeated.

The cleaning fluid from pump (48) through mandril (77) and internal brushes (100), 100' is the cleaning agent at the brush area inside the pipe. The cleaning fluid from pump through nozzles (49) is the cleaning agent at the brush area on the outside of the pipe. All the cleaning fluid introduced into the brush areas is held captive by the wiper (110), pipe seal (34), cover (31) and catch pan (15). The catch pan directs fluid into a fine mesh screen basket (18) through spout (15*s*).

The filtered fluid overflows from the smaller compartment (17*a*) over a vein 19 into the large compartment of tank (17*b*) completing fluid cycle.

The flexible coupling (48*h*) may connect directly to nozzles 49 and to the coupling (58). Alternatively, a valve (200) may be provided and a conduit (202) provided to a separate cleaning unit (204). A valve (206) is provided to cut off communication between the separate cleaning unit (204) and the conduit (48*h*). The cleaning unit (204), for example, may be a hydro cyclone. The hydro cyclone (204) is not a part of this invention and will not be described further. Cleaning fluid from the hydro cyclone (204) is conveyed by means of a conduit (208) to the line (48*h*) and thence into nozzles (49) and coupling (58). Impure material is removed from the hydro cyclone (204) by means of a removable bottom (212) into a container (214) which may be periodically dumped.

In most instances fluid is conveyed only to the hydro cyclone (204) when the cleaning unit (29) is in operation.

What is claimed is:

1. Apparatus for cleaning pipe and tubing comprising a first cleaning unit;
   - a generally longitudinally extending mandril located within said first cleaning unit; means for rotating said mandril drivably connected to said mandril;
     - at least one internal cleaning brush removably mounted upon said mandril; said internal cleaning brush rotatable with said mandril;
     - at least one external cleaning brush laterally spaced from said mandril;
     - means for placing said mandril in driving engagement with said external cleaning brush for rotating said external cleaning brush;
     - means for moving pipe or tubing longitudinally relative to said first cleaning unit internal and external brushes whereby the internal surface of the pipe or tubing engages said first cleaning unit internal brush, and the external surface of said pipe or tubing engages said first cleaning unit external brush, and whereby rotation of said first cleaning unit internal and external brushes relative to said pipe or tubing causes a cleaning action upon the pipe or tubing; and
     - means for moving the pipe or tubing away from said first internal and external cleaning brushes after said cleaning operation has been completed.

2. Apparatus according to claim 1 including a second cleaning unit laterally spaced from said first cleaning unit at an opposite end of the pipe or tubing to be cleaned and comprising;
   - a generally longitudinally extending second mandril;
   - means for rotating said second mandril drivably connected to said second mandril;
     - at least one second cleaning unit internal brush removably mounted upon said mandril; said second internal cleaning brush rotatable with said second mandril;
     - at least one second cleaning unit external brush laterally spaced from said second mandril;

means for placing second mandril in driving engagement with said second cleaning unit external cleaning brush for rotating said second cleaning unit external cleaning brush;

means for moving pipe or tubing longitudinally relative to said second cleaning unit internal and external brushes whereby the internal surface of the pipe or tubing engages said second cleaning unit internal brush and the external surface of said pipe or tubing engages said second cleaning unit external brush and whereby rotation of said second cleaning unit internal and external brushes relative to said pipe or tubing causes a cleaning action upon the pipe or tubing; and means for moving the pipe or tubing away from said second cleaning unit internal and external brushes after said cleaning operation has been complete.

3. Apparatus according to claim 2 wherein a plurality of external cleaning brushes are provided in said second unit and wherein said external cleaning brushes are located outward of said second internal cleaning brushes and in driving engagement with said second mandril in said second unit.

4. Apparatus according to claim 1 wherein a plurality of first external cleaning brushes are provided, each longitudinally spaced from said first internal cleaning brush and in driving engagement with said first mandril.

5. Apparatus according to claim 4 wherein means are provided for varying the distance that said external cleaning brushes are located with respect to said mandril.

6. Apparatus according to claim 5 wherein said external brushes are located longitudinally outward of said first internal cleaning brush.

7. Apparatus according to claim 1 wherein the means for rotating said mandril and rotating said external brush is structured so that said mandril and said external brush rotate at different rates.

8. Apparatus according to claim 7 wherein a fixed gear is located radially outwardly from said mandril and wherein said external brush is integral with a moveable gear which rotates about said fixed gear.

9. Apparatus according to claim 8 wherein said external brush is driven by a first shaft which is in driving engagement with said moveable gear and wherein said brush is laterally spaced from said first shaft and is directly driven by a second shaft.

10. Apparatus according to claim 9 wherein said external brush is driven by said first shaft upon which said external brush is mounted and by said second shaft is integral with said moveable gear and drive means which transfer rotational energy from said first shaft to said second shaft.

11. Apparatus according to claim 10 wherein said second shaft is pivotably mounted about a housing for said first shaft.

12. Apparatus according to claim 11 including means for varying the angularity of said second shaft with respect to said first shaft.

13. Apparatus according to claim 12 wherein said second shaft is resiliently mounted with respect to the said first shaft.

14. Apparatus according to claim 11 wherein stop means are provided to control the extent to which said second shaft may be rotated relative to said first shaft.

15. Apparatus according to claim 8 wherein said fixed gear is integral with a vertically extending plate and gear means for raising and lowering said plate.

16. Apparatus according to claim 15 wherein said mandril is located within said fixed gear and wherein movement of said fixed gear assembly also raises and lowers said mandril.

17. Apparatus according to claim 15 wherein a covering is removeably attached to said plate and wherein said covering extends longitudinally parallel to said mandril and wherein said cover includes a vertically extending end portion having an opening therein and wherein a removeable seal assembly is mounted within said opening.

18. Apparatus according to claim 17 wherein keeper means are provided for removably maintaining said seal in place within said opening.

19. Apparatus according to claim 1 wherein means are provided for spraying cleaning fluid upon the external surface of said pipe or tubing and wherein means are provided for reclaiming said cleaning fluid.

20. Apparatus according to claim 19 wherein said means for reclaiming said cleaning fluid comprises a pan located generally below said cover.

21. Apparatus according to claim 20 wherein means are provided for cleaning said cleaning fluid prior to its recirculation.

22. Apparatus according to claim 21 wherein the means for cleaning said cleaning fluid comprises a container located below said pan and wherein means are provided for directing such cleaning fluid from said pan into said cleaning apparatus.

23. Apparatus according to claim 22 wherein the means for cleaning said cleaning fluid comprises at least one screen basket and wherein means are provided for circulating said cleaning fluid through said cleaning basket.

24. Apparatus according to claim 23 wherein pump means are provided for recirculating said cleaning fluid into said mandril and into the pipe or tubing.

25. A method of cleaning tubing and pipe comprising:

providing at least one generally longitudinally extending mandril located at a first end of pipe or tubing to be cleaned;

removably attaching at least one internal cleaning brush to said mandril;

locating at least one external cleaning brush laterally spaced from said mandril, but in driving engagement therewith; rotating said mandril and thereby said internal cleaning brush, and said external cleaning brush;

moving the pipe longitudinally relative to said internal and external brushes, whereby the internal surface of the pipe or tubing engages the first internal brush and the external surface of the pipe or tubing engages the external brush, and whereby the rotative action of the internal and external brushes causes a cleaning of the pipe or tubing, and moving the pipe or tubing away from the internal and external brushes after the cleaning operation has been completed.

26. A method according to claim 25 wherein at least one second internal cleaning brush longitudinally spaced from said first cleaning brush and removably mounted on the mandril is provided.

27. A method according to claim 26 wherein a plurality of external cleaning brushes are provided, each of which is laterally spaced from said internal cleaning brushes and varying the distance that said external brushes are located with respect to said mandril as different diameter pipe is treated.

28. Method according to claim 25 including moving said mandril, said internal cleaning brush and said external cleaning brush vertically to adjust the apparatus to accept different diameter pipe and tubing.

29. A method according to claim 25 including providing an outwardly extending wiper which engages the internal surface of said pipe or tubing and which as said pipe or tubing is withdrawn cleaning fluid and debris is removed from the pipe or tubing.

30. A method according to claim 29 including reclaiming the cleaning fluid applied to said pipe or tubing, and recirculating the reclaimed cleaning fluid as additional pipe or tubing is cleaned.

31. A method according to claim 30 wherein said cleaning fluid is cleaned prior to circulating it to additional pipe or tubing.

* * * * *